US006085757A

United States Patent [19]

Jenkins et al.

[11] Patent Number: 6,085,757

[45] Date of Patent: Jul. 11, 2000

[54] METHOD AND APPARATUS FOR CREATING ART ON AN OBJECT SUCH AS THE NAIL OF A PERSON'S DIGIT OR A GOLF BALL

[75] Inventors: Nevin C. Jenkins; Rande W. Newberry, both of Homosassa; Antonio Lebron, Spring Hill, all of Fla.

[73] Assignee: Fashion Nails, Inc., Homosassa, Fla.

[21] Appl. No.: 09/076,790

[22] Filed: May 13, 1998

[51] Int. Cl.[7] ..... A45D 29/00

[52] U.S. Cl. ..... 132/200; 132/73; 101/41; 101/DIG. 40

[58] Field of Search ..... 132/73, 285; 101/DIG. 40, 101/33, 163, 166, 193, 41

[56] References Cited

U.S. PATENT DOCUMENTS

| | | | |
|---|---|---|---|
| 1,594,431 | 8/1926 | Thomson | 101/DIG. 40 |
| 2,519,335 | 8/1950 | Ballou et al. . | |
| 2,524,322 | 10/1950 | Lipnicki et al. | 132/285 |
| 2,701,520 | 2/1955 | Rider | 101/41 |
| 2,842,046 | 7/1958 | Murray . | |
| 3,598,685 | 8/1971 | Lee et al. | 132/73 |
| 3,916,784 | 11/1975 | Dubuit . | |
| 4,508,032 | 4/1985 | Phillipp . | |
| 4,803,922 | 2/1989 | Dennesen | 101/41 |
| 5,090,320 | 2/1992 | Nave | 101/41 |
| 5,133,369 | 7/1992 | Billings | 132/73 |
| 5,269,330 | 12/1993 | Hayes | 132/73 |
| 5,302,224 | 4/1994 | Jenkins et al. | 101/163 |
| 5,316,026 | 5/1994 | Jenkins | 132/285 |
| 5,743,180 | 4/1998 | Arnke | 101/DIG. 40 |

*Primary Examiner*—Todd E. Manahan
*Attorney, Agent, or Firm*—Evenson, McKeown, Edwards & Lenahan, PLLC

[57] ABSTRACT

A hand operated self-contained machine made out of molded plastic for applying an image on a nail of a person's digit or a golf ball, consisting of a base frame including side rails. An element is provided to establish a reference point. An image creating holder is integrally molded to the side rails. A wheel having projections holding a plate containing a plurality of images is supported on the holder and can be indexed to any one of a plurality of positions by the interaction of the projections and the holder. An image composed of an image defining coating material is created at one image position on the plate. A positioning member receives and adjustably positions a person's digit or object in an appropriate orientation relative to the reference point. A transfer member is mounted on the side rails and a manually operable drive member drives the transfer member, and a method wherein the support of the image plate is indexed to present a new image.

20 Claims, 14 Drawing Sheets

METHOD AND APPARATUS FOR CREATING ART ON AN OBJECT SUCH AS THE NAIL OF A PERSON'S DIGIT OR A GOLF BALL

FIELD OF INVENTION

The present invention relates to a method and apparatus for creating art on an object, and more particularly, relates to a method and hand operated apparatus for creating an art image on an object, such as, the nail of a person's digit or a golf ball.

BACKGROUND AND SUMMARY OF THE INVENTION

The desirability of creating art images on a person's fingernails and toenails is widely recognized and practiced. Known techniques include transfers, decals, appliques and hand painting. Recently, U.S. Pat. Nos. 5,277,205; 5,302,224; and 5,316,026 have been granted regarding novel techniques for creating images on nails using hand operated apparatus. Although the new technology works well in principle, there remains a need to further develop the technology in order to advance it to the point where complex multicolor images can be created consistently and repeatably with excellent registration and detail. Also, there remains a need to improve and engineer the known apparatus to enable manufacture both efficiently and economically. Especially there remains a need to develop an effective method and apparatus that will perform with high accuracy and which will be inexpensive.

Therefore, the principal object of the present invention is to provide a method and apparatus for effectively creating art on the nail of a person's digit or on an object, such as, a golf ball, and to do so to accomplish the noted purposes. To this end, the invention provides a unique hand-operated apparatus that can be manufactured efficiently and readily substantially entirely out of plastic, and that will be of rugged construction and will function effectively, smoothly and repeatably. The apparatus is substantially less costly to make than apparatus hereto proposed.

Accordingly, the present invention achieves the principal object of the invention by a method for applying an art image on a person's nail or an object, such as, a golf ball that comprises the steps of establishing a reference point, positioning a person's digit or the object in a specially configured block, located relative to the reference point, at a first preselected location, creating an image composed of an image defining coating material at a location remote from the first preselected location, picking up the created image from an engraved plate at said remote location by a transfer assembly including an operating pin, transferring the picked up image to the person's nail or the object at said first preselected location, and depositing the picked up image onto the person's nail or object at a position on the nail or object correlated with the reference point by manipulation of the operating pin.

In the method, the picked up image is preferably transferred by a linear motion. Also, the depositing of the picked up image is preferably effected by a linear motion. Further, the transfer of the picked up image may be effected with guiding. The step of creating the image may include the steps of depositing coating material onto the plate and doctoring excess coating material in the creation of the image. The method steps can be repeated a multiple of times with repositioning of the plate between successive times. The method can further include a step of positively stopping the picked up created image in proper orientation to the person's nail or object during transfer, and the positioning of the nail or object can be adjustable. The method can be carried out to create a multi-color image.

The present invention additionally contemplates a hand operated self-contained, plastic apparatus for applying an image on a person's nail or an object, such as, a golf ball comprising a frame for establishing a reference point, a member which is preferably a wheel mounted on the frame that can be positioned successively in a plurality of positions, an image creating plate received in said wheel for creating thereon an image composed of an image defining coating material, a digit or object positioning member having a recess for receiving and positioning a person's digit or an object relative to the location of the created image, an adjusting device for locating the person's digit or the object in an appropriate orientation relative to the reference point, and a transfer assembly including an operating pin mounted on the frame movable for transferring the created image from the image creating plate to the person's nail or the object.

The apparatus may further be characterized in that the transfer assembly includes a squeegee for removing excess coating material from an image and a pick up pad for picking up a created image. The apparatus can further include guide elements some of which are on the wheel to guide the transfer assembly during movement, and the guiding can be by a singular linear guide path. In the apparatus, the squeegee and the pick up pad may be mounted in common, with the pad and squeegee each mounted for vertical movement. The apparatus may further comprise an adjustable member serving to index the nail or object relative to the reference point. Also, the apparatus may have a digit positioning member spring biased upwardly in a digit holding block.

BRIEF DESCRIPTION OF THE DRAWINGS

Other objects, advantages and novel features of the present invention will become apparent from the following detailed description of the invention when considered in conjunction with the accompanying drawings.

DESCRIPTION OF PREFERRED EMBODIMENTS

Figure 1:
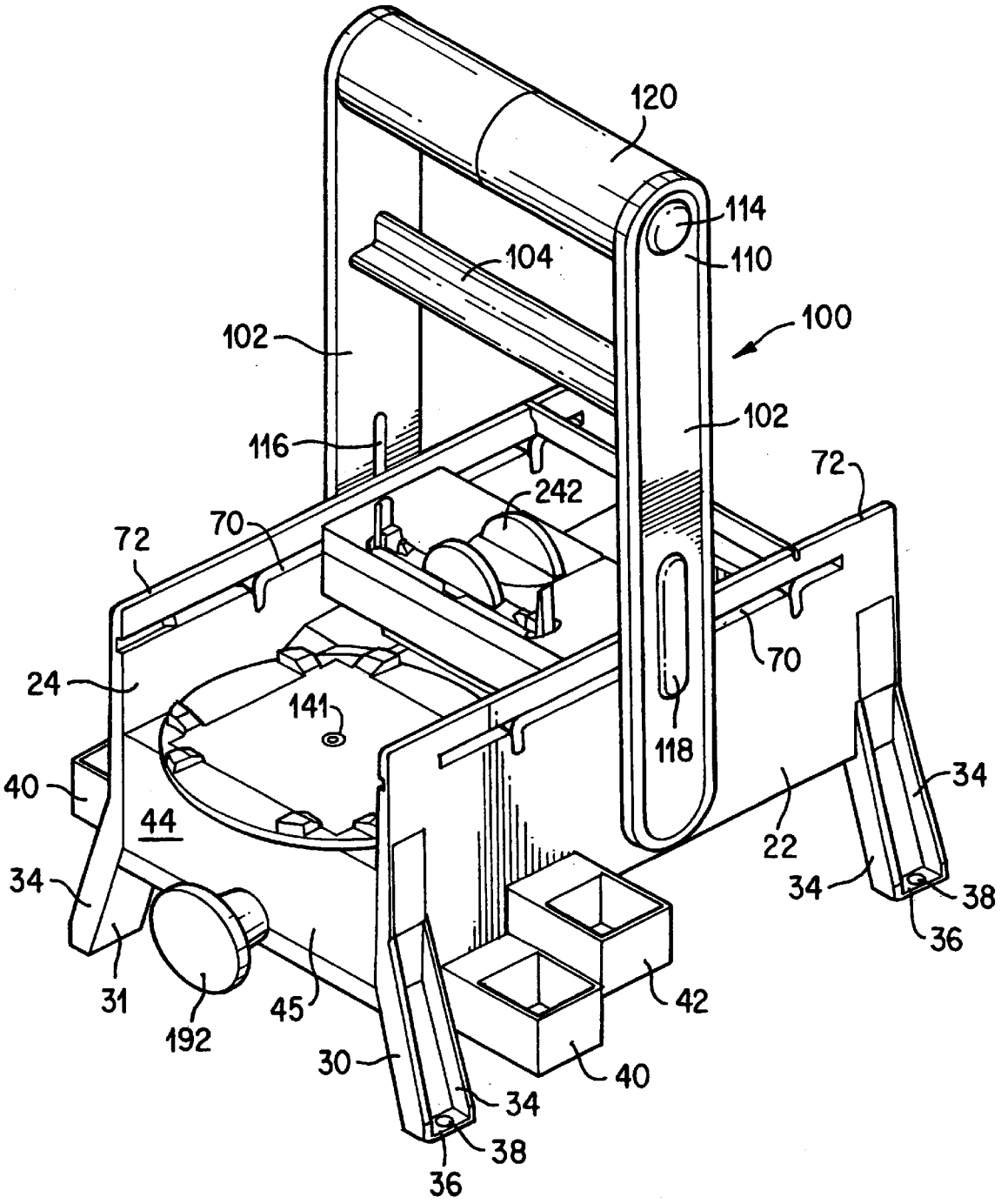
FIG. 1 is a perspective view of the apparatus of the present invention.

Referring now to the drawings, preferred embodiments of the present invention will be described in detail. As shown principally in FIGS. 1 and 2, the apparatus consists of an integrally molded plastic frame 20 in which two side rails 22 and 24 are held in vertical, parallel, transversely spaced apart relation by a pair of horizontally extending, parallel, longitudinally spaced apart ribs 26 and 28. Four legs 30, 31, 32 and 33 are formed integral with the outside surfaces of side rail 22, 24 essentially at their longitudinally ends. Each leg 30–33 includes a U-channel shaped depending portion 34 inclined or splayed at an angle of 10° to 30° from vertical for contacting a supporting surface such as a table and for holding the side rails 22, 24 of the apparatus spaced above the supporting surface. At the terminating or free ends of portions 34 is a web 36 in which a throughbore 38 is formed for attachment of a suction pad (not shown) or for attachment to a supporting surface to hold the apparatus steady during use. The throughbore 38 can also be a slot.

At the lower rear of each side rail 22, 24 are formed a pair of receptacles or boxes 40, 42 staggered in height or position, rear-to-front, with the front box 42 being slightly elevate with respect to the rear box 40. The boxes 40, 42 serve to hold four containers of coloring material. Between the side rails 22, 24, at their rear, is formed a L-shaped plate member holder base 44 having a central upper recess 46 inset into and below the surface 48 of base 44. The side edges of base 44 are integrally formed with the inside surfaces of rails 22, 24 or otherwise secured thereto, such as, by cementing, heat bonding, or adhesively securing. Plate member holder base 44 is of an L-shaped planar structure, that is, it has a vertical wall 45 and a horizontal wall or floor 47. Recess 46 is circular in horizontal cross section and defines four equally peripherally spaced (90° apart) circular or arcuate cutouts or recesses 50 about its wall perimeter, and a central or axial through hole 52. At the lower rear of holder base 44, a through hole 54 is defined parallel with the longitudinal axis of the apparatus (and in the vertical longitudinal plane).

At the front of the side rails 22, 24 and integrally molded on their inside surfaces, toward, adjacent or in proximity with the lower edges of rails 22, 24, are a pair of transversely spaced, longitudinally, parallel extending ribs or guide bars 56 which extend from immediately adjacent the front of the apparatus rearwardly terminating at about one-third the front-to-rear length. At about the middle of the side rails 22, 24 front-to-rear and top-to-bottom, and integrally molded on their inside surfaces are a pair of longitudinally and parallel extending guide plates 58 in a horizontal orientation so they extend normal to their respective side rails 22, 24 a short distance transversely. Guide plates 58 each present an upper guide surface 60, an incline or ramp 62 at its rear end that lies in proximity with surface 48, a rear cutout 64 and a front cutout 66 defining projection 68.

A longitudinally, horizontally extending slot 70 is formed in each side rail 22, 24 adjacent or in proximity with the upper edge 72 of side rails 22, 24. Each slot 70 extends from adjacent or in proximity with the rear and to adjacent or in proximity with the front. Each slot 70 has a front section 74, a rear section 76 and a middle section 78. The side rails 22, 24, at the intersections 80 of the front section 74 and middle section 78, define short vertical branch slots 82 leading downwardly ending in an arcuate termination 84. Similarly the side rails 22, 24, at the intersections 86 of the rear section 76 and middle section 78, define short vertical branch slots 88 leading downwardly ending in an arcuate termination 90.

A throughbore 92 is formed in each side rail 22, 24 at the longitudinal mid-point near, but spaced above, the bottom edge 94 of the rail 22, 24. A boss 93 encircles bore 92 on the outside surface of each side rail. The upper edge 72 of each side rail 22, 24 defines a vertical small slot 96 with an arcuate bottom 98, in exact vertical axial alignment with the down slot 82 of the side rail 22, 24. The through bore 92 may be surrounded by a boss 93, as shown, or the boss may be omitted.

Figure 2:
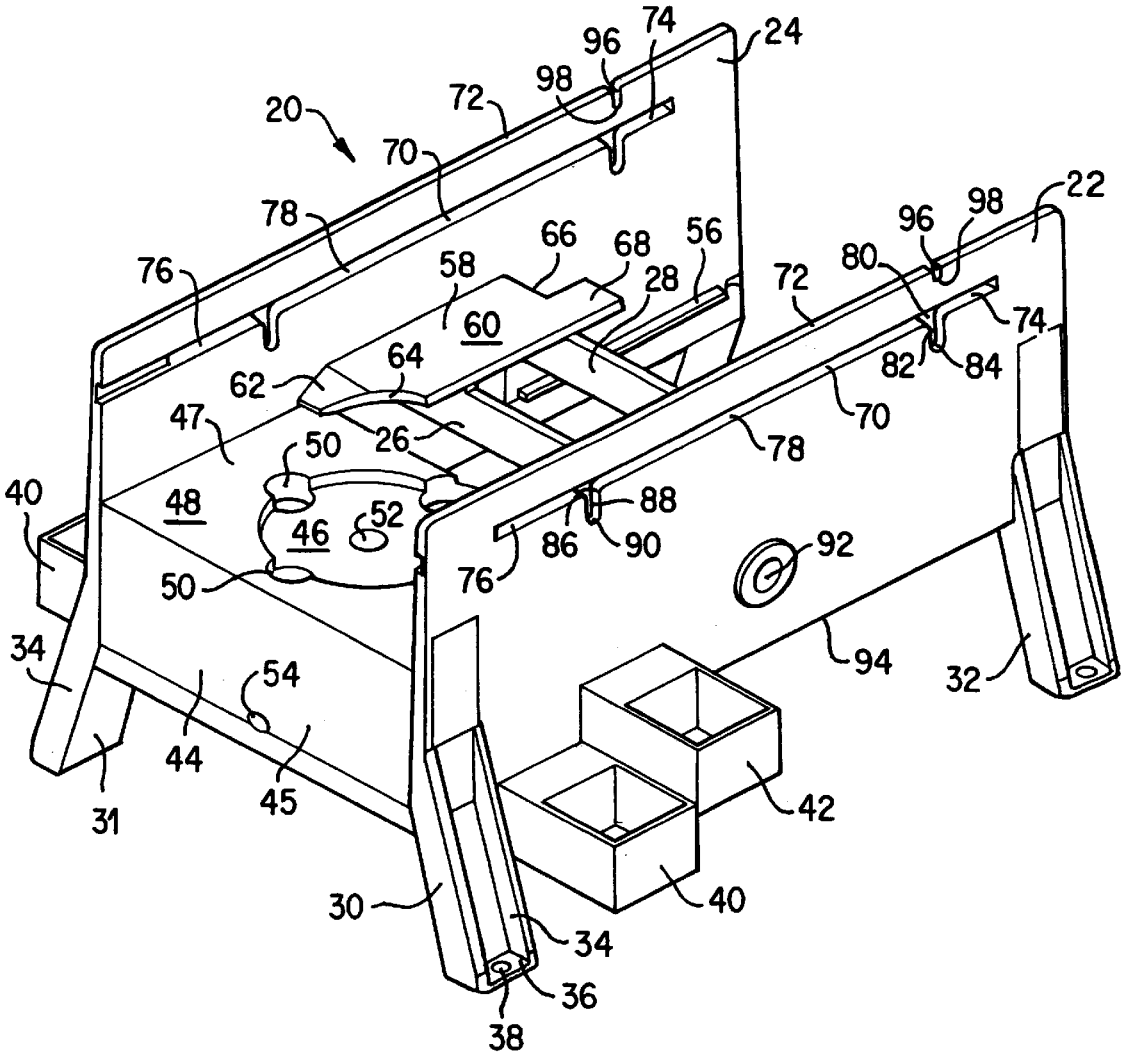
FIG. 2 is a perspective of the frame of the apparatus shown in FIG. 1.
Figure 2A:
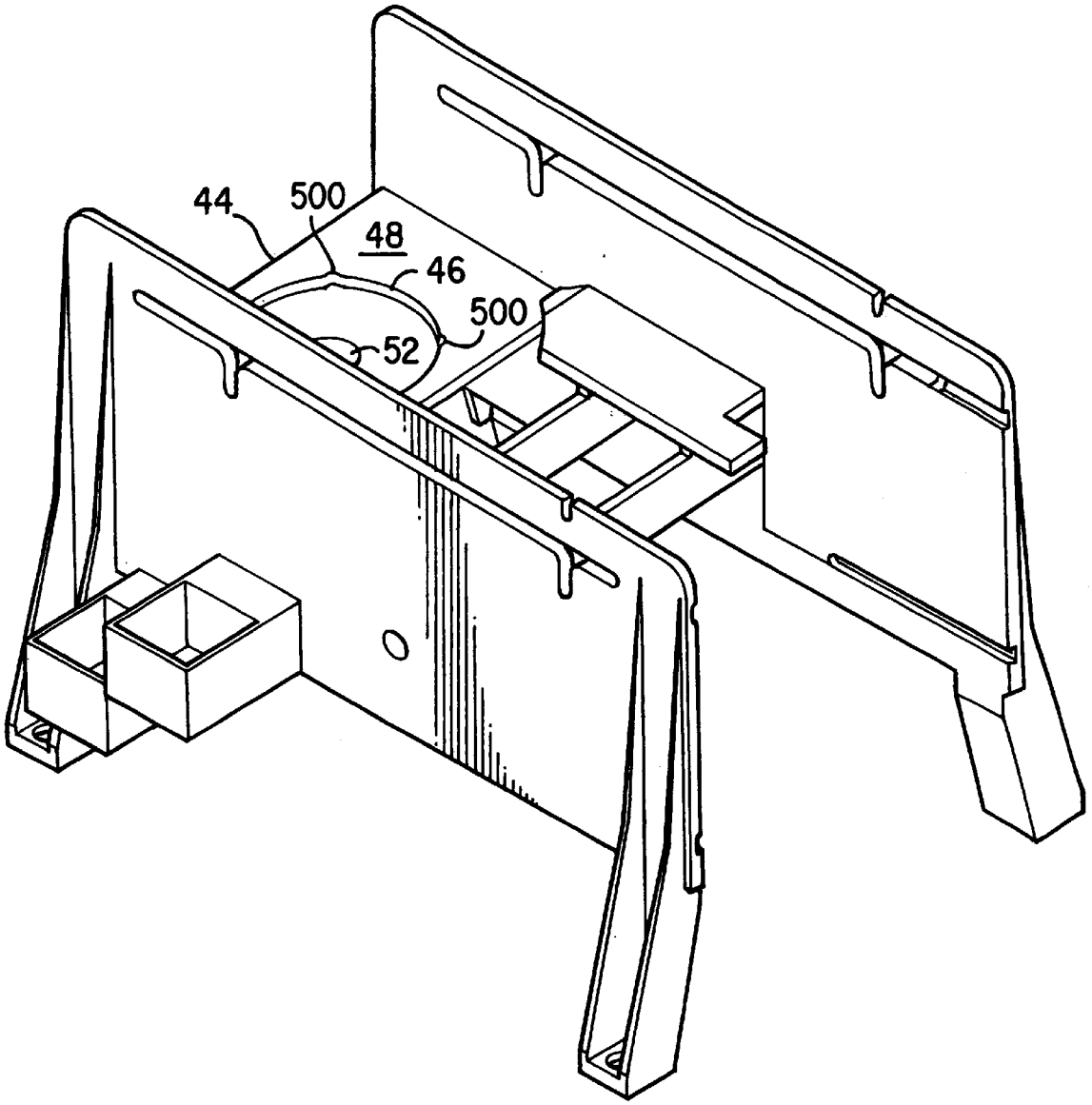
FIG. 2A is a perspective of a preferred embodiment of the frame shown in FIG. 2.

A preferred form of the frame of FIG. 2 is shown in FIG. 2A. The essential difference is that the L-shaped plate member holder base 44 is formed with a central upper recess 46 inset into and below the surface of 48 of base 44 and is provided with four equally peripherally spaced V-shaped recesses 500 which extend radially beyond the periphery of recess 46 into surface 48 and base 44. Also, central axial throughbore 52 is provided which extends through the planar formation of base 44. Otherwise, the construction is essentially the same as shown in FIG. 2.

Figure 3:
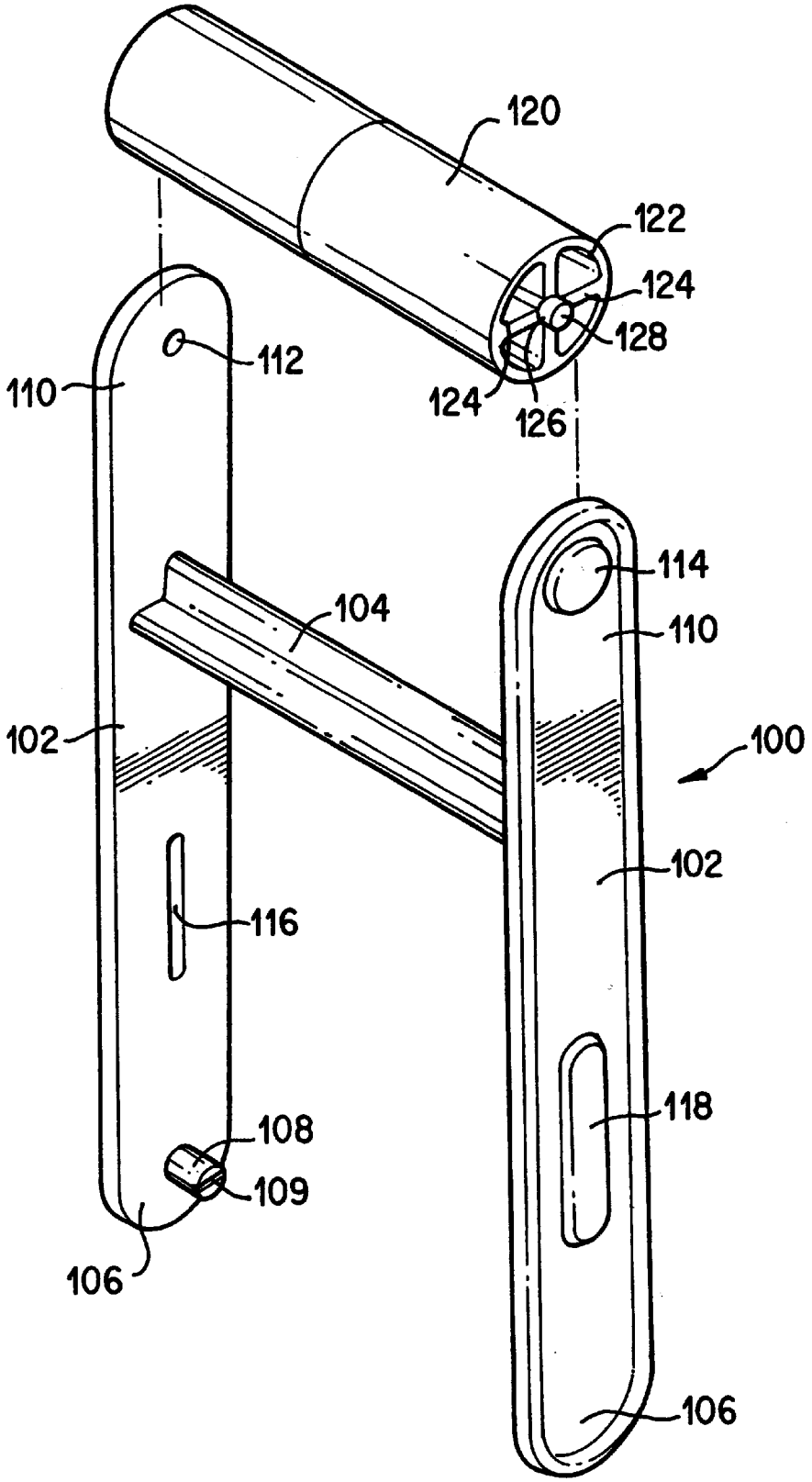
FIG. 3 is an exploded perspective of the operating lever.

An operating lever 100 of plastic is shown in FIGS. 1 and 3. Lever 100 consists of a pair of elongated arms 102 integrally interconnected in parallel spaced relation by an integrally molded L-shaped strut 104. The lower ends 106 of arms 102 on their inner surfaces define integrally molded inwardly facing slotted pivot pins 108 (slotted longitudinally as indicated by reference numeral 109) which are received resiliently in throughbores 92 when the lever 100 is assembled to side rails 22, 24, as shown in FIG. 1, by flexing resilient arms 102 outwardly and snap fitting pins 108 into bores 92. The upper ends 110 of arms 102 define through holes 112 which are capped over on the outside of arms 102 by integrally molded caps 114. Intermediate the strut 104 and lower ends 106 of arms 102, longitudinally extending slots 116 are defined, also capped over on the outside of arms 102 by integrally molded caps 118. A roller handle 120 is molded as an elongated annular cylindrical shell 122 with integral internal radial stiffening ribs 124 in cruciform shape defining an axial hub 126 at each end from which projects a projecting mounting pin 128. Mounting pins 128 are received in through holes 112 when handle 120 is assembled to the arms 102 which for this purpose are flexed outwardly, the arms being of sufficient resiliency for this action.

Figure 13A:
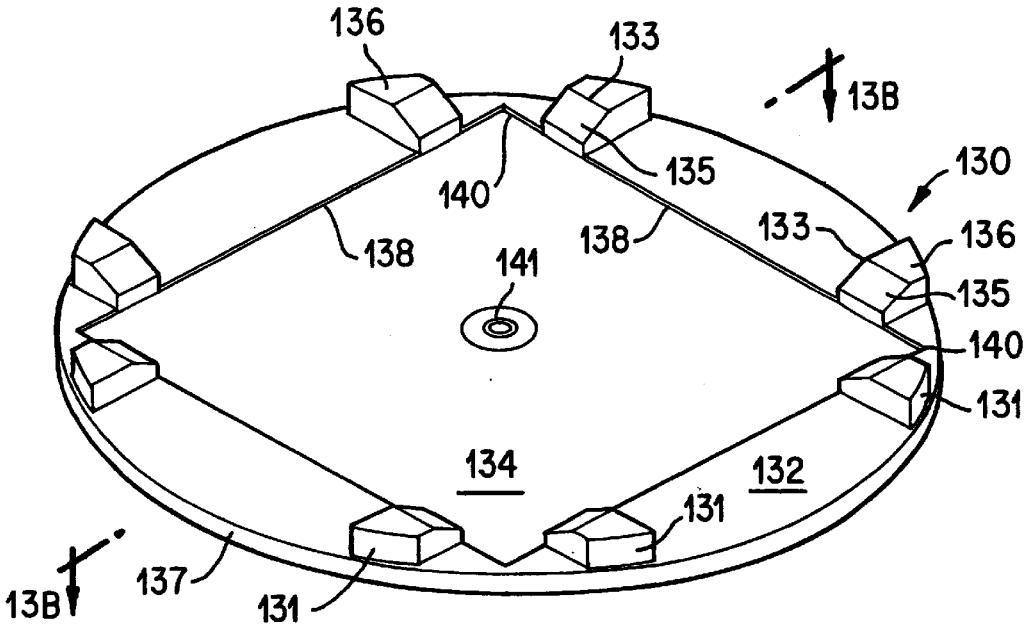
FIG. 13*a* is a perspective of the plate holder.
Figure 13B:
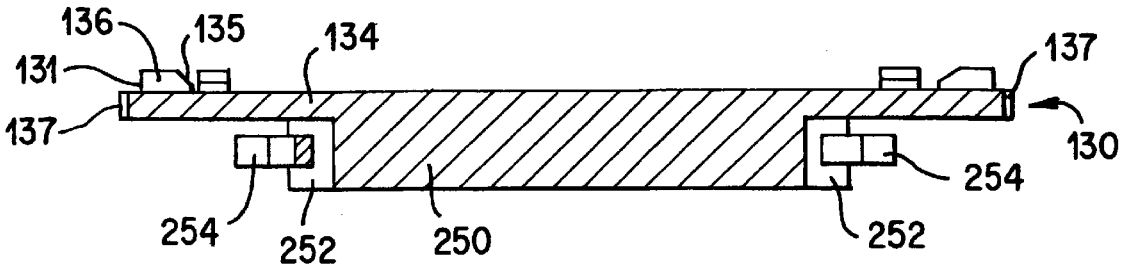
FIG. 13*b* is a section of FIG. 13*a* taken along line 13*b*–13*b*.

A plate holder thumb wheel or turntable 130, shown in FIGS. 13*a* and 13*b*, mold in plastic, is adapted to be removable mounted, installed or positioned in recess 46 of plate holder 44. Wheel 130 defines on its upper surface 132 a recessed square plate receiving area 134 onto which an engraved plate (of metal or plastic) is to be received, as will be explained subsequently. Index guide blocks or pads 136 are integrally formed on the upper surface 132, a pair on each side 138 of area 134 adjacent to corners 140. Each of the pads 136 extends from the periphery of wheel 130 and has an arcuate outer wall 131. Each pad 136, from about its mid point 133, inclines downwardly to the associated side 138 to form a guide ramp 135 for a purpose to be explained. When the wheel 130 is mounted, the height of each pad 136 brings it to the plane of guide surface 60 with the two most forward pads fitting into the rear cutouts 64, so that guide ramps are provided on both sides of the wheel 130 leading forward to guide surfaces 60. This will be true regardless of what the position is of wheel 136, provided it is rotated in 90° increments. There will always be two pads 136 in the forward most position, one in each of the cutouts 64 providing ramps 135 to the guide surfaces 60. Wheel 130 has a bore 141 at its center. A locking snap pin 250, seen in FIG. 19 holds wheel 130 rotatably in recess 46.

The bottom of wheel 130 is seen best in FIG. 13*b*. As shown, the edge of wheel 130 is knurled as indicated by reference numeral 137 and has a central depending hub 250 having a diameter substantially equal to or just slightly less than recess 46, so that wheel 130 can be mounted in recess 46 snugly, but with the ability to rotate. Hub 250 has four equally spaced recess 252 with integrally molded L-shaped plastic springs or flexible clips 254 projecting out of the recesses 252 normally or in repose beyond the periphery of hub 250. Clips 254 act as detents and are trapped in recesses 50 as wheel 130 rotates in recess 46. Since there are four recesses 50, the wheel 130 can be successively rotated into four positions 90° apart. Recess 46 and hub 250 can be provided with any number of matching recesses 50 and clips 254 from 2 to about 8, and the wheel 130 with the correspondingly appropriate number of and appropriately positioned pads 136.

Figure 15:
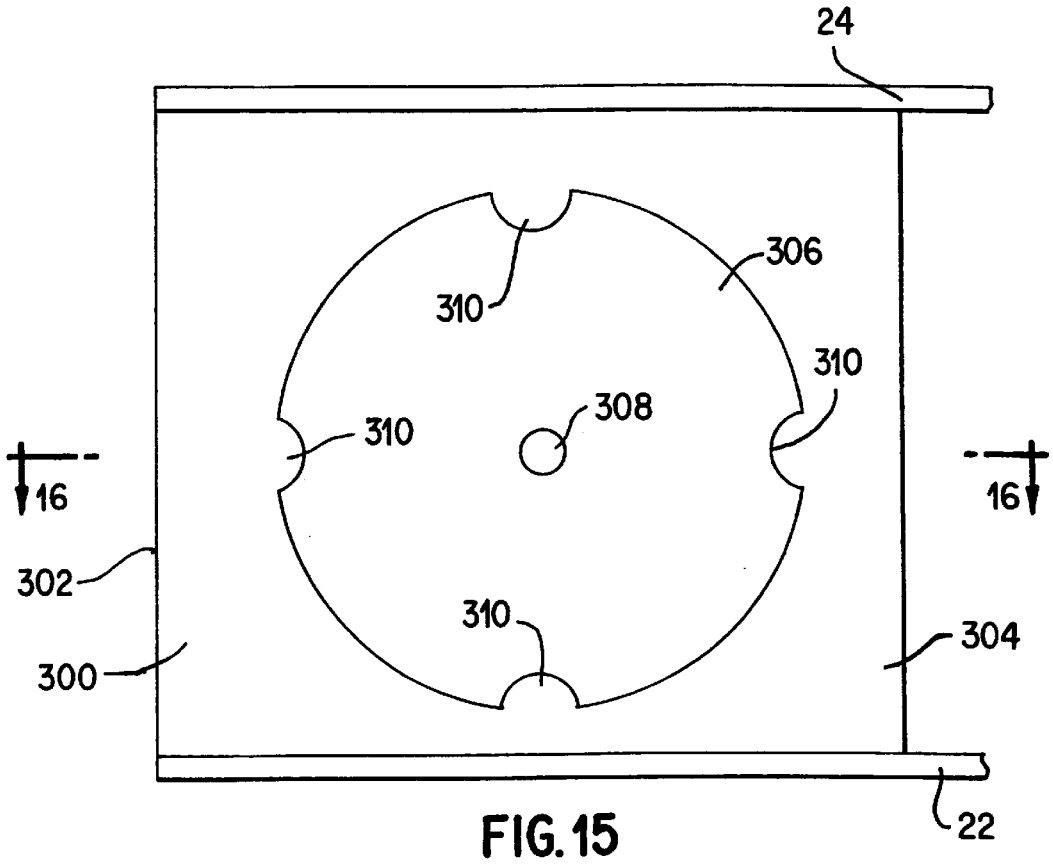
FIG. 15 is a top view of another wheel holder.
Figure 16:
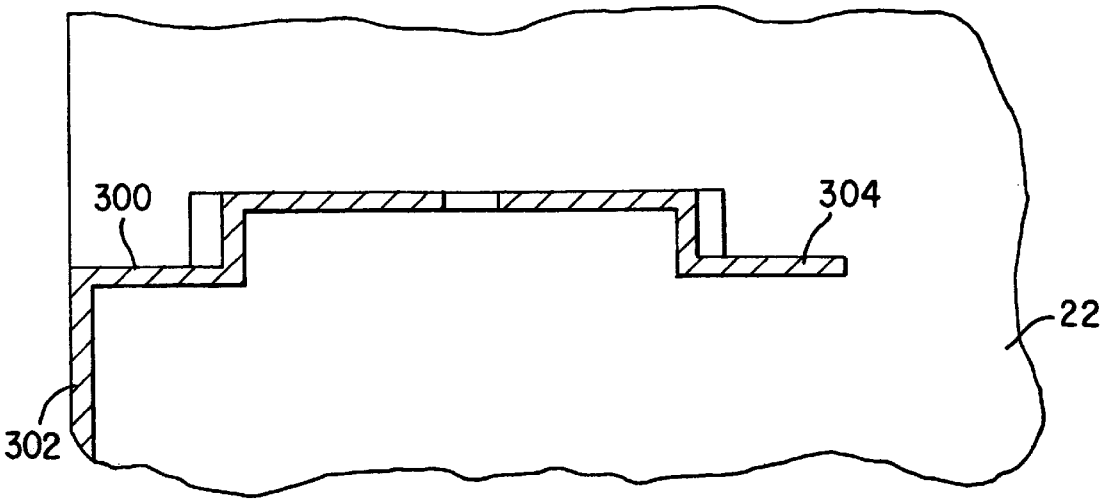
FIG. 16 is a section taken along line 16—16 of FIG. 15.

An alternative construction for the base 44 is shown in FIGS. 15 and 16 and consists of an L-shaped base 300 integrally molded to side rails 22, 24 and having a downward rear wall 302 and a horizontally extending wall 304 from which centrally projects upwardly a circular hub 306 having an axial through hole 308 and four equally peripherally spaced inward recesses 310.

Figure 14:
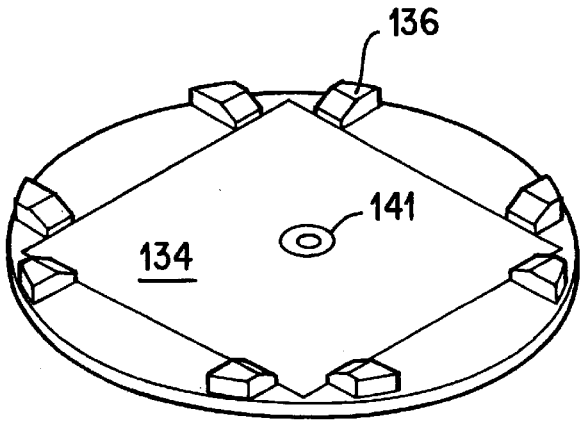
FIG. 14 is a perspective of another plate holder.
Figure 17:
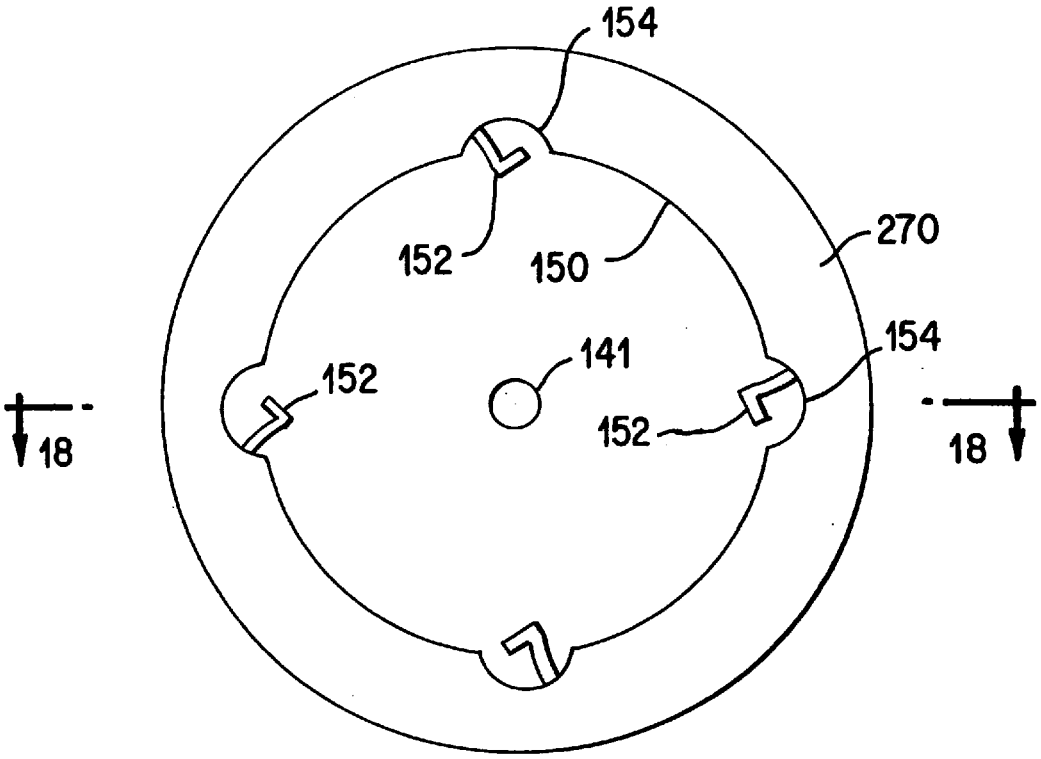
FIG. 17 is a bottom view of another wheel.
Figure 18:
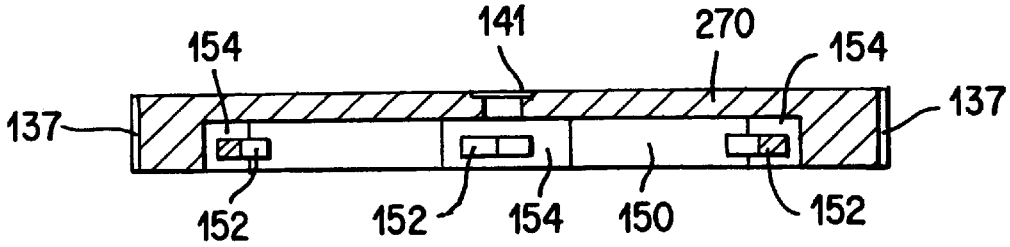
FIG. 18 is a section taken along line 18—18 of FIG. 17.
Figure 19:
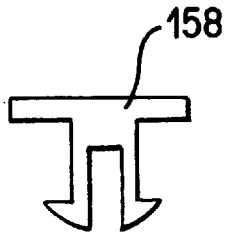
FIG. 19 is a side elevation showing the locking snap pin to hold a wheel on the wheel holder.

An alternative molded wheel 270 is shown in FIGS. 14, 17 and 18 for cooperation with base 300. Wheel 270 has a central recess 150 formed axially in the bottom of wheel 270 with recess 150 having a diameter equal to hub 306, or ever so slightly greater (tolerance) to enable wheel 270 to slip onto hub 306 with a good snug fit while enabling relative rotation. Also, recess 150 is preferably of a depth equal to the height of hub 306 so that wheel 270 mounted on hub 306 is adequately supported by the upper surface of base 300. Further, a hole 156 is axially formed in the recess 150 of wheel 270. At four equally spaced (90°) locations about recess 150 are integrally molded L-shaped springs or resilient clips 152 that normally or in repose project from relief recesses 154 into the circular area defined by recess 150. When wheel 270 is mounted on hub 306, clips 152 are received in recesses 310 to resiliently bias the wheel 270 to one of its four stationary positions. A locking snap pin 158, as shown in FIG. 19 holds wheel 270 in the exact center of the base 300 and hub 306 by fitting into hole 308 and hole 141, suitably countersunk for this purpose, so the recessed area for holding an engraved plate has a uniform bottom surface. Pads 136 are present, but omitted in these views for simplicity.

Figure 23:
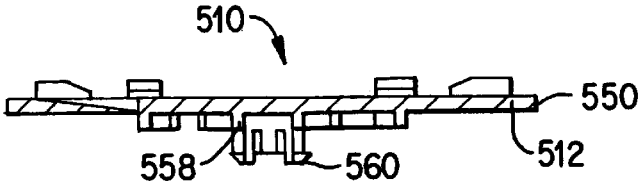
FIG. 23 is a diametrical sectional view of the plate holder of FIG. 21.
Figure 22:
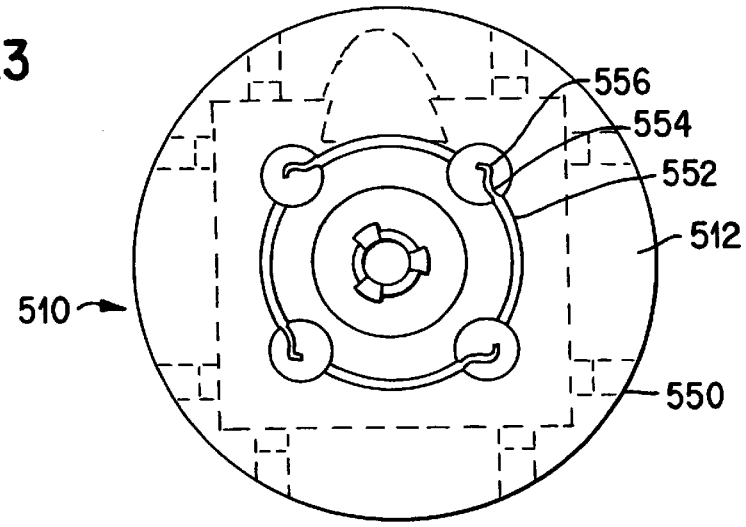
FIG. 22 is a bottom view of the plate holder of FIG. 21.
Figure 21:
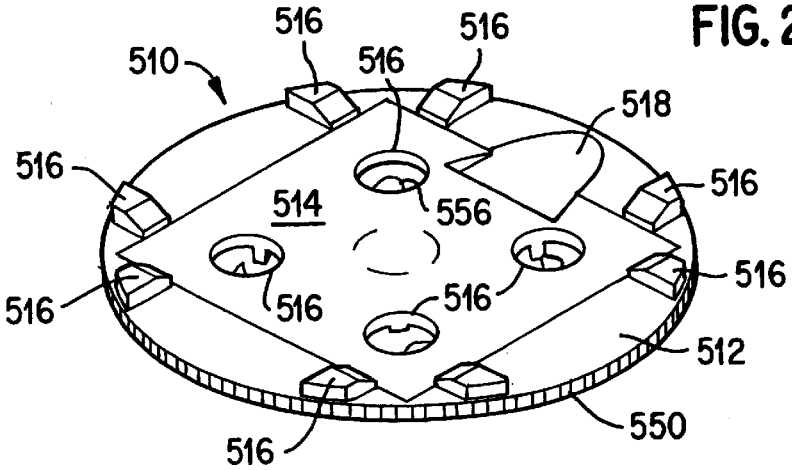
FIG. 21 is a perspective view of a preferred embodiment of the plate holder.
Figure 24:
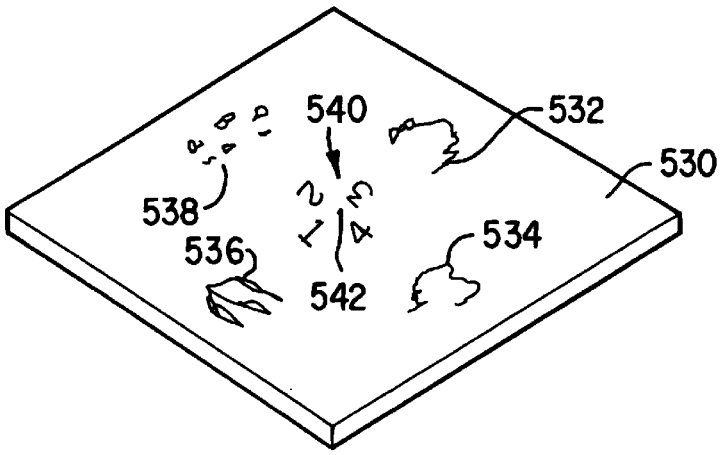
FIG. 24 is a perspective view of a typical engraved plate.

An alternative and preferred embodiment of the wheel plate holder is shown in FIGS. 21–23 and consists of an integrally molded part generally designated by reference number 510. The preferred holder 510 is designed to fit into recess 46 as shown in FIG. 2A. The holder 510 consists of a circular planar wheel 512 provided with a central square recess 514. An array of four relatively large through bores 516 extend from the bottom of recess 514 through wheel 512. Abutting each edge of recess 514 are a pair of index guide blocks 516 as described with reference to FIG. 13A. A finger access recess 518 is formed wheel 512 extending from adjacent the rim 550 of wheel 512 into the area of recess 514. A plate 530, like that shown in FIG. 24, fits into recess 514. Engraved or cut into plate 530 are four images 532, 534, 536 and 538, one adjacent each plate edge. Identifying indicia 540 are formed in the proximity of the center 542 of the plate; each indic. is associated and references one image. As shown, the images constitute component parts of a single pictorial image and therefore, collectively will form the single pictorial image when transferred in succession. Wheel 512 has a knurled or wavy edge or rim 550 to facilitate its rotation.

Molded on the bottom surface of wheel 512 are four peripherally spaced, arcuate, depending ribs 552, each starting from the periphery of a throughbore 516 and extending to the next peripherally adjacent throughbore 516. The ribs 552 lie on a common circle. Each of the ribs 552 has a termination 554 which extends into the opening of a bore 516 and is in the form of a thinner rib extension with a terminal deformation of V-shaped 556. The terminal deformations 556 lie radially outside the common circle of the ribs 552. A central, depending, integrally molded split pin 558 having three sections extends from the axial center of the bottom of wheel 512. Pin 558 defines an enlarged head 560.

Wheel 512 is mounted on the base 44 shown in FIG. 2A with pin 558 extending through hole 52 and head 560 holding wheel 512 securely, but detachably, in recess 46. Ribs 552 bear against the peripheral edge of recess 46 and, normally, V-shape deformations 556 are received in corresponding V-shaped recesses 500, thereby holding wheel 512 in a stationary position. If it is desired to rotate wheel 512, a rotary force is applied to wheel 512 via rim 550 in an appropriate direction, and the wheel 512 can advance, successively, from position to position.

Figure 7:
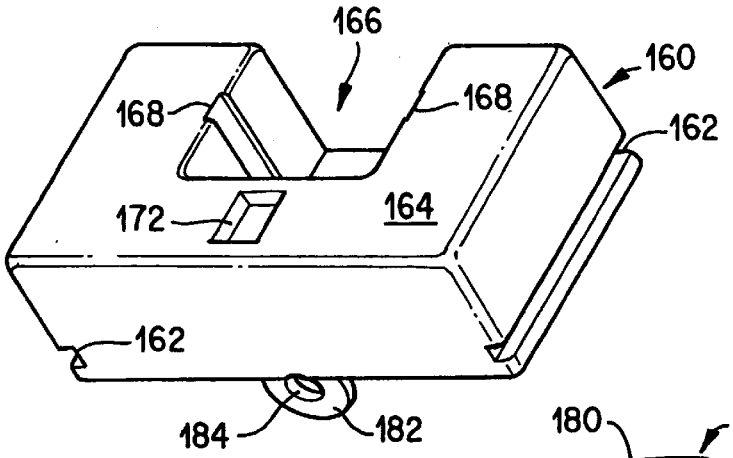
FIG. 7 is a perspective view of the nail block holder.
Figure 10:
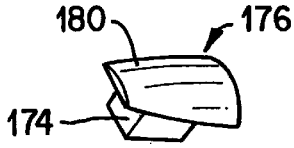
FIG. 10 is a perspective of an insert.
Figure 11:
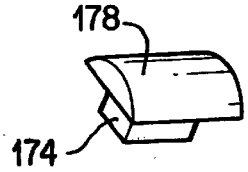
FIG. 11 is a perspective of another insert.
Figure 7A:
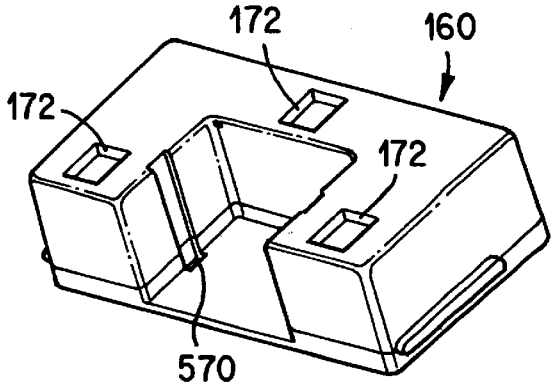
FIG. 7A is a perspective view of a preferred embodiment of the nail block holder.
Figure 20:
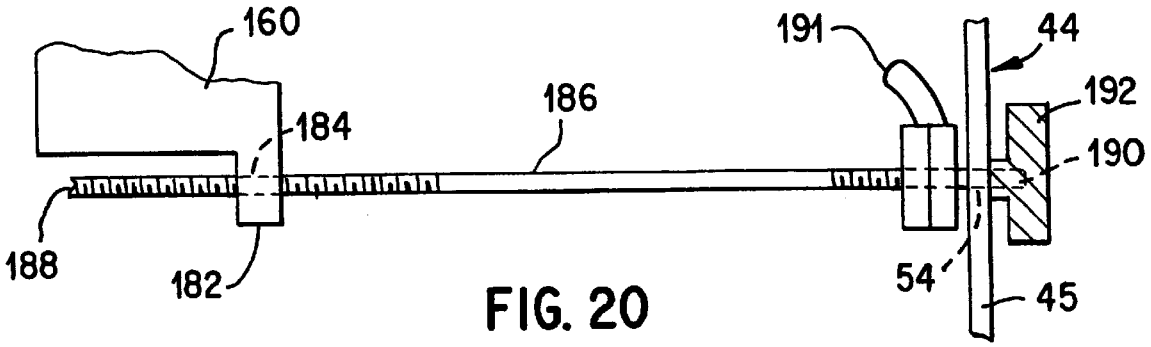
FIG. 20 is a view in side elevation showing the elongated threaded adjusting rod.

At the front of the apparatus a nail holder block 160 is located, see FIG. 7. Block 160 consists of a molded rectangular, block-shaped, hollow structure having known internal reinforcing ribs. The outer surface 164 of block 160 defines side longitudinally extending guide slots 162 matching and for registry with ribs 26, 28 for mounting block 160 in sliding relation with side rails 22, 24. Outer surface 164 is deformed on the forward side to define an open recess 166 with side vertical grooves 168 to receive a nail holder 170, see FIG. 8. Through openings 570, see FIG. 7A, are provided at the bottoms of the grooves 168. Just rearward of recess 166 is a rectangular through hole 172 for receiving a complementary plug 174, rectangular in cross section, see FIGS. 10 and 11. In a preferred embodiment, three such rectangular holes 172 are provided, in the pattern shown in FIG. 7A. A nail rest 176 is fixed to the top of plug 174 by adhesive or being integrally molded therewith, and may alternatively consist of a chord of a right cylinder 178, see FIG. 11, or a simulation of a person's nail 180 see FIG. 10. At the bottom rear of the holder 160 is a depending lug 182 formed with a threaded through bore 184. Threaded bore 184 is aligned in elevation with bore or hole 54. When block 160 is mounted between the side rails 22, 24 in sliding relation, as described, an elongated rod 186 having a threaded forward end 188 extends through hole 54 at its rear end 190 and is threadedly engaged with block 160 via lug 182 and threaded bore 184 at its forward end, see FIG. 20. A knurled knob 192 is fixed to the rear end of rod 186 by any suitable means. A pair of nuts 191 tightened together, or a ring clip, prevent axial movement of rod 186 when rotated. When knob 192 is turned, it causes rod 186 to rotate, causing, in turn, block 160 to slide fore or aft relative to the side rails depending on the sense of rotation (CW or CCW) of knob 192. Knob 192 is fixed to the rear end 190 of rod 186 immediately aft of plate holder 44 as shown in FIG. 20.

Figure 8:
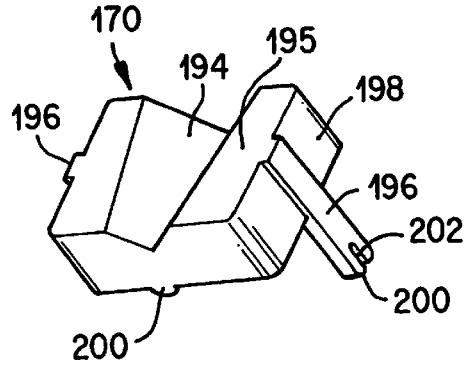
FIG. 8 is a perspective of the nail block.
Figure 8A:
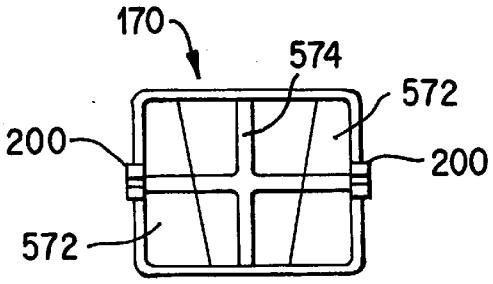
FIG. 8A is a bottom view of the nail block.

The nail holder 170 is shown in FIGS. 8 and 8A and consists of hollow square block having a V-shaped groove 194 formed in its upper surface 195. V-shaped groove 194 rises in elevation front-to-rear. A pair of vertical ribs 196 are integrally formed on the sides 198 of holder 170 with the ribs extending downwardly below holder 170. The lower free ends 200 of ribs 196 are slotted vertically as indicated by reference numeral 202 and enlarged at their ends as shown. When nail holder 170 is mounted in block 160, ribs 196 are received in guide slots or grooves 168 for vertical sliding movement of holder 170 with the lower ends 200 passing through openings 570, see FIG. 7A, and being detachably trapped by their enlarged ends. The hollow interior is divided into four compartments 572 by the cruci form rib structure 574. Coil springs, not shown, are placed, one in each compartment 572, or 1 larger diameter spring fitting in the hollow bottom, to normally bias block 170 upwardly. When it is trapped in recess 166 of block 160.

Figure 12:
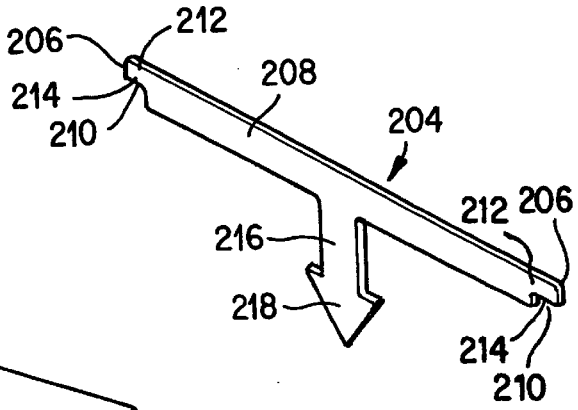
FIG. 12 is a perspective of an index element.
Figure 9:
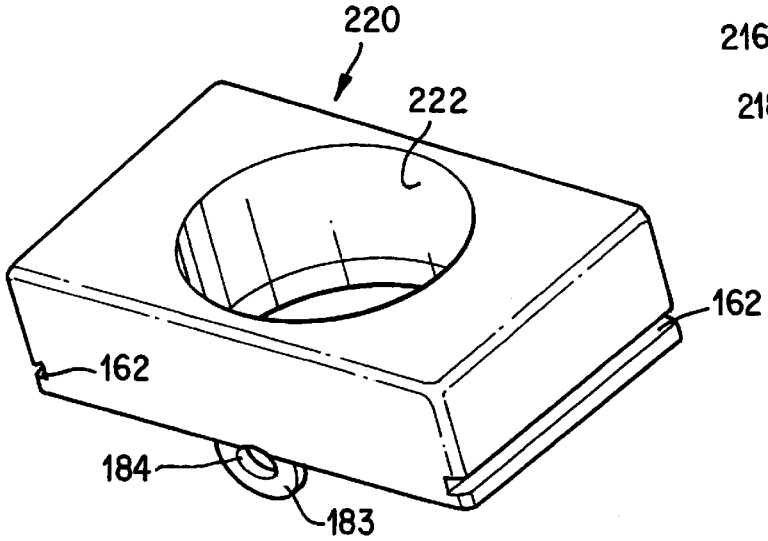
FIG. 9 is a perspective of the golf ball holder.

When block 160 is mounted between rails 22, 24, as described, and holder 170 is mounted in block 160 as described, an index pointer 204 shown in FIG. 12 is placed on the side rails 22, 24, as shown in FIG. 1. Pointer 204 consists of a narrow flat T-bar with the ends 206 of the cross portion 208 notched at 210 to produce narrowed short terminal projections 212 having arcuate bottom surfaces 214. The thickness of the T-bar equals or is slightly less than slots 96 and the arcuate bottom surface 214 of each projection 212 is complementary to the arcuate bottom 98 so that the index pointer 204 can be mounted on the side rails 22, 24, as shown in FIG. 1 with the flat bar vertical and with depending leg portion 216 extending down and terminating in a pointing arrow 218 just above the nail holder 170. When a person's digit, e.g. finger is placed in the V-groove 194 with the terminal finger pad engaging the rear surface of recess 166 or the forward end of nail rest 176 (with plug 174 in hole 172) and the end of the fingernail overlying nail rest 176, block 160 can be moved fore and aft by manipulation of knob 192, as described. This has the effect of positioning or adjusting longitudinally the person's fingernail relative to the pointing arrow 218 which shows precisely where an image will be deposited onto the fingernail by the proper operation of the inventive apparatus.

In place of using block 160 and nail holder 170, another molded block 220 can be used. Block 220 is also a hollow block, suitably internally reinforced with ribs if desired. Both block 160 and block 220 may be open at the bottom. Block 220 is provided on its sides with guide slots 162 and at its rear bottom with lug 182 and threaded bore 184. Block 220 has a central vertical throughbore 222 sized to hold a particular object. The geometry of throughbore 222 depends upon the geometry of the object to be held and have an imaged imposed on it. In the specific embodiment illustrated, throughbore 222 is circular in horizontal cross section and is dimensioned in diameter just smaller than a golf ball so that a golf ball can be held snugly enough and at the proper elevation for deposit of an image through proper operation of the inventive apparatus.

Figure 4:
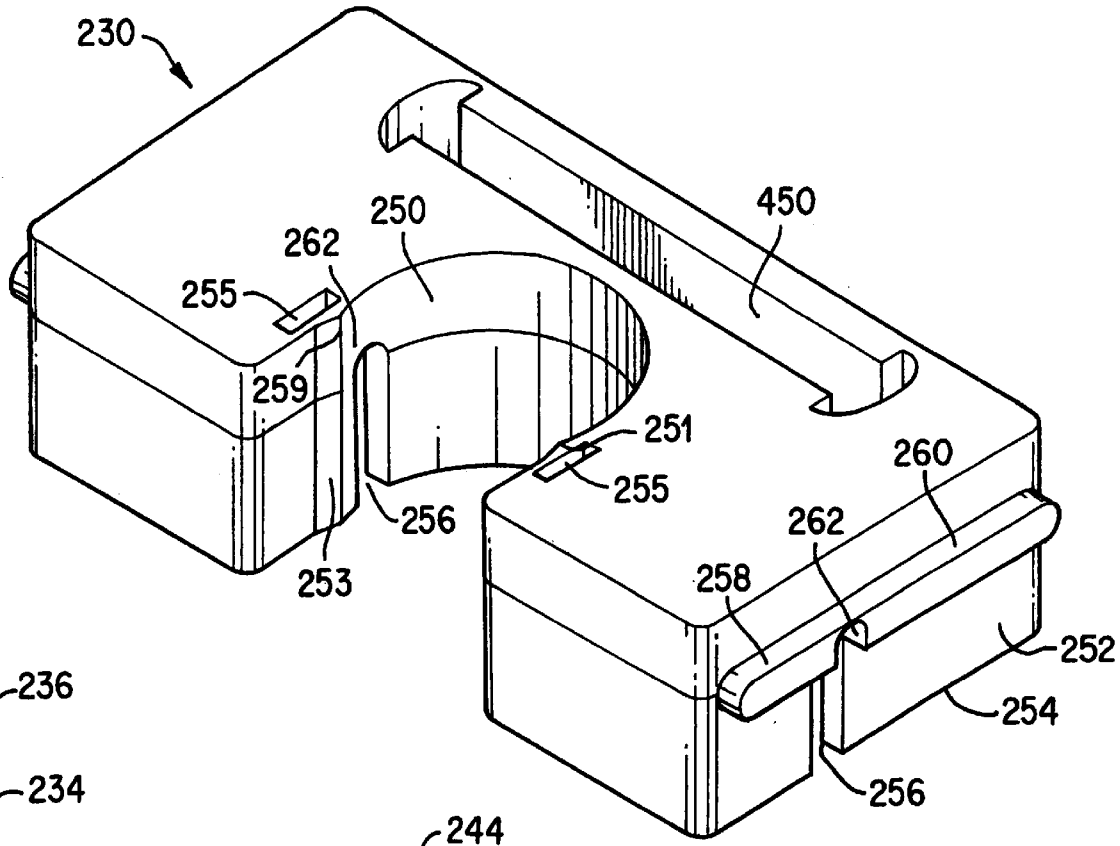
FIG. 4 is a perspective of the pick-up and squeegee block.
Figure 5B:
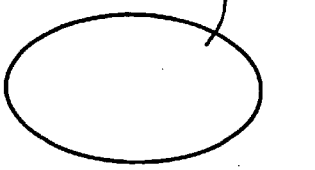
FIG. 5B is a view of a silicone pick-up pad.
Figure 5A:
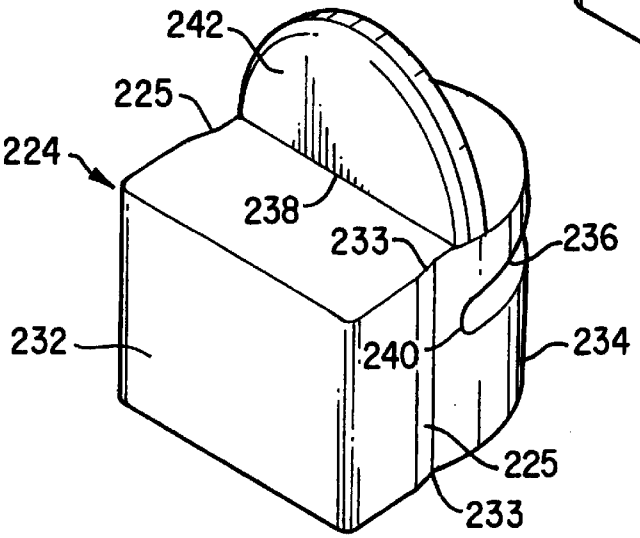
FIG. 5A is a perspective of the pick-up head.
Figure 6A:
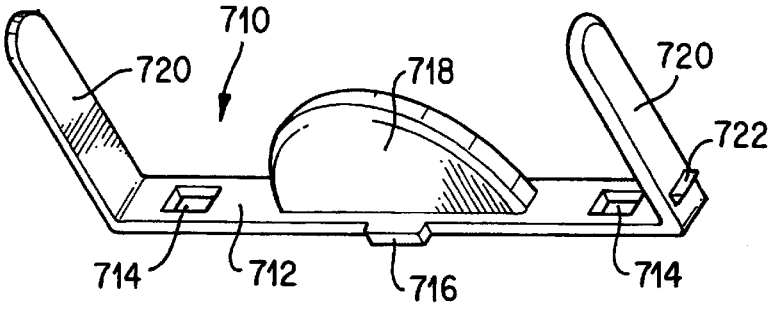
FIG. 6A and 6B are perspective views of preferred embodiments of components of the squeegee assembly.
Figure 6B:
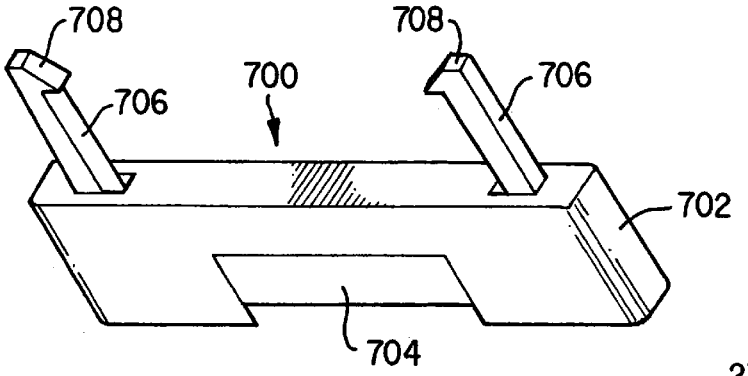
Figure 5C:
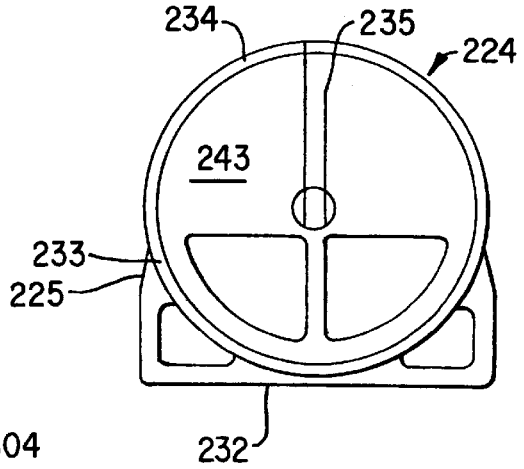
FIG. 5C is a bottom view of the pick-up head.
Figure 6:
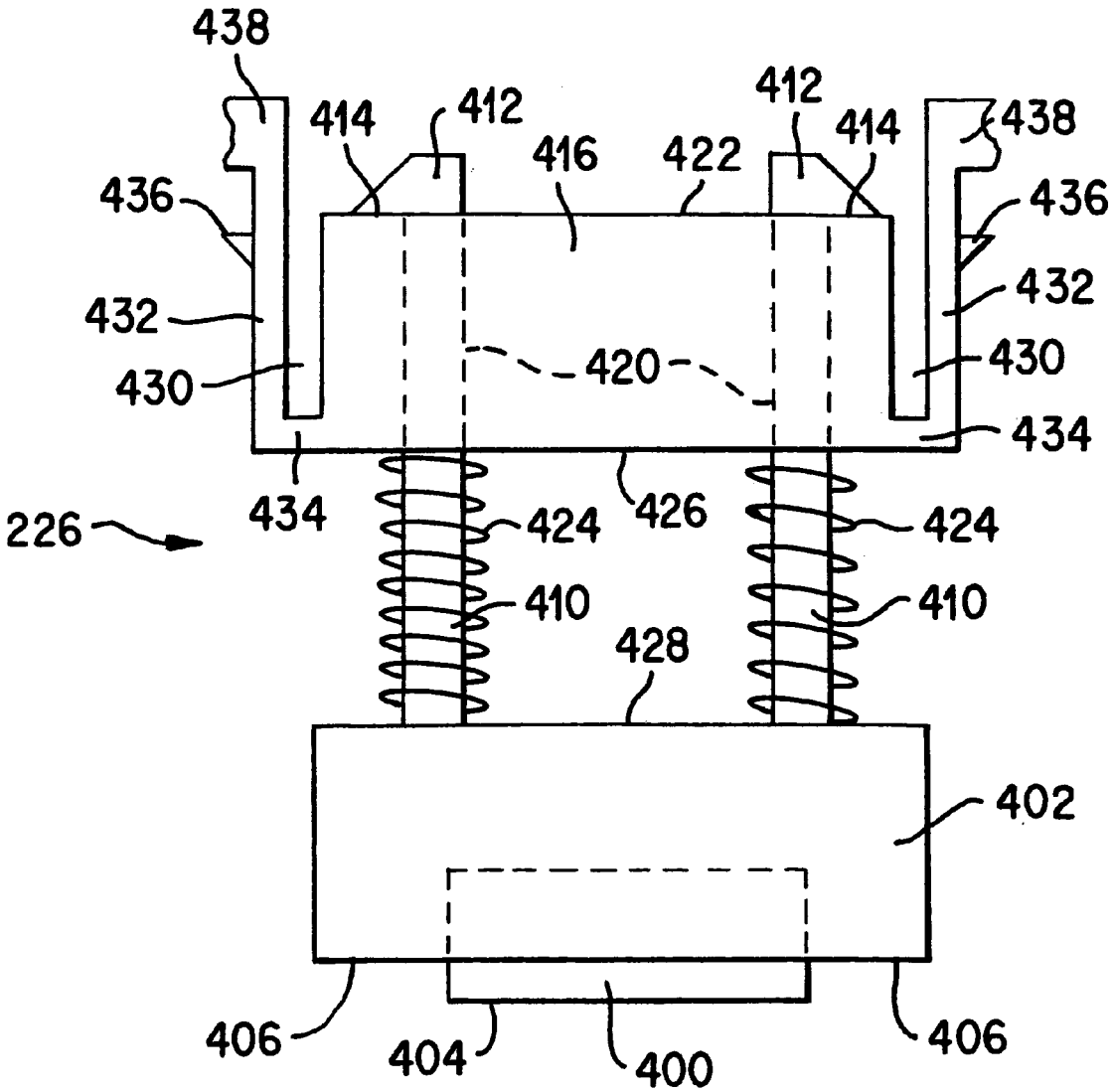
FIG. 6 is a side elevation showing the squeegee assembly.

A pad holder 224, a squeegee holder 226 and an assembly block 230 are shown in FIGS. 4–6. Pad holder 224 is an integrally molded hollow block open at the bottom. The front side 232 of holder 224 is square in configuration and the rear side 234 is rounded, more than half a circle so that a line defined between the front side 232 and rear side 234, at the juncture point 233 is less than the diameter of the circular rounded rear side 234, see in particular FIG. 5C. Also, the interior of holder 224 is reinforced by rib structure 235. A rearward opening, horizontal slot 236 is formed extending from the rear side 234 to about the middle 238 of holder 224. The slot 236 is slightly enlarged at its most forward and transversely longest point and formed with an arcuate end wall 240. A vertically projecting lifting lug 242 of semicircular configuration stands up from about middle 238 to facilitate handling. The bottom of holder 224 provides a cavity 243 to receive in press fit a rounded image lifting pad 244 composed of silicone.

Assembly block 230 is a hollow molded, suitably reinforced open bottom block and has a forward facing recess 250 complementary in shape to receive the holder 224 with the rear side 234 received deepest into recess 250. A pair of vertical slots 256 extend in the sides 252 of block 230 from the bottom edge 254 to a point short of the top, and in the same horizontal plane that includes slot 236. Also, in this horizontal plane are horizontal extending side ribs 258 and 260 fore and aft, respectively, of the upper rounded termination 262 of slots 256. Recess 250 defines a point 251 corresponding to point 233. That is the rounded or circular part of recess 250 extends more than half a circle so that a line from point 251 to point 251 on opposite side, is shorter than the diameter of the circular portion of recess 250, thus establishing a narrowing. To the front side of points 251, recess 250 is inclined outwardly as indicated by reference numeral 253. Outwardly of inclines 253 are a pair of vertical rectangular through bores and recesses 255 which allow resilient flexing and expansion of the opening into recess 250 to enable the pad holder 224 to be introduced horizontally, and when inserted, to be resiliently trapped in recess 250. The front side 232 of the pad holder 224 defines inclines inwardly 225 in front of junction points 233 to establish seats for inclines 253.

Squeegee holder 226 is shown in FIG. 6 and consists of a thin metal doctor blade 400 that is fixed in a molded blade holder block 402 with the lower edge 404 of blade 400 lying horizontal and protruding downwardly a short distance or exposure. Blade 400 is held in the center of block 402 so that the bottom surfaces 406 of block 402 on both sides of blade 400 are free and clear. These surfaces 406 cooperate with blocks 136 and guide surfaces 60 to lift blade 400 vertically a clearance distance. Integrally molded to the upper surface 408 of block 402 are two laterally spaced, vertically parallel extending posts 410 which terminate at their upper free ends 412 in trapezoidal caps that define a horizontal shoulder 414. A mounting block 416, having a pair of laterally spaced, vertically parallel extending through bores 420, is mounted in freely sliding relationship, on posts 410 with the posts 410 extending through the bores 420 and with the shoulders 414 adapted to bear on the upper surface 422 of block 416. A pair of coil springs (compression) 424 surround posts 410 and bear against the bottom surface 426 of block 416 at their tops and against the upper surface 428 of block 402 at their bottoms. Thus, springs 410 resiliently bias block 416 upwardly. On each side block 416 is defined a vertical slot 430 extending from top surface 422 downwardly terminating in proximity with bottom surface 426 to define a side lever 432 connected to the main portion of block 416 by a narrow web 434 to enable lever 432 to flex or pivot about web 434. A step projection 436 extends outwardly from each lever 432 just above its mid-elevation and a gripping knob or cap 438 is fashioned at its upper free end.

Assembly block 230 defines a transversely extending elongated throughbore 450 dimensioned and shaped to accommodate squeegee holder 226. The transverse sides 452 of bore 450 part way into the depth of bore 450 are recessed (not shown) in a fashion complementary to projections 436 so that if holder 226 is inserted downwardly into the bore 250 until projections 436 click into the recesses, holder 226 cannot be lifted upwardly out of bore 250 unless the levers 432 are pivoted toward each other to draw the projections 436 out of their respective recesses and free holder 226 for vertical lifting upwardly. When holder 226 is locked into block 230, a spring force is exerted on the doctor blade urging it down.

Assembly block 230 is mounted between the side rail 22, 24, generally at their mid point, with side ribs 258 and 260 received in slots 70. An operating pin (not shown) consisting of a round rod having a diameter just less than the width of slot 70 is inserted through one slot 70, through the block 230 via slot 256 and through the other slot 70. At this time the ends of the rod project outwardly from the slots 70. The arms 102 are then brought into positions such that the ends of the rod are received in the capped slots 116. The pad holder 224, with pad 244 inserted into its bottom cavity is then introduced into recess 250 so that slot 236 is forced over the rod until it snaps into and against wall 240. Squeegee holder 226 is now inserted downwardly into bore 450 until projections 436 snap into the complementary recesses in bore 450. At this time the bottom side surfaces 406 will be bearing on guide surfaces 60 lifting doctor blade holder 402 vertically against the force of springs 424.

Figure 4A:
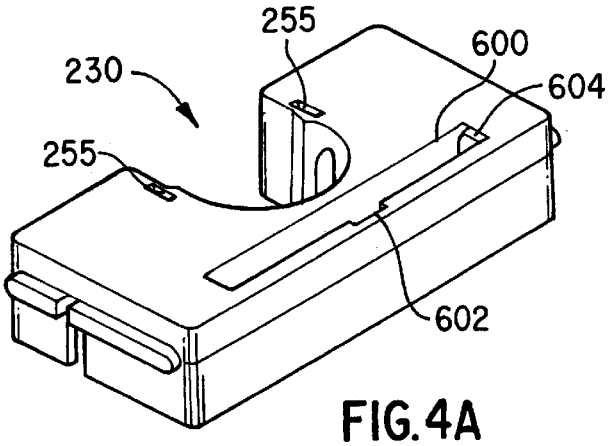
FIGS. 4A and 4B are perspective and bottom views of a preferred embodiment of te block shown in FIG. 4.
Figure 4B:
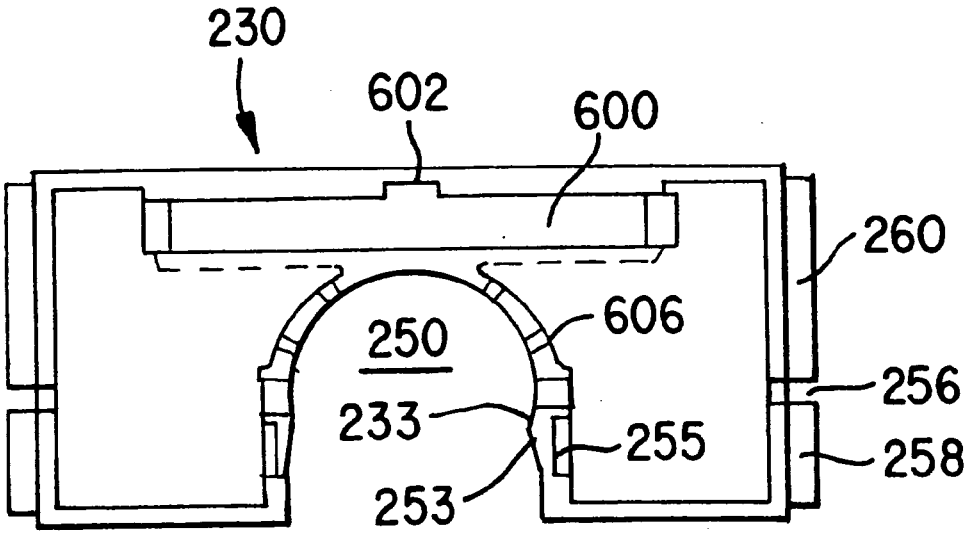

An alternative and preferred structure for block 230 and squeegee holder 226 is shown in FIGS. 4A and 4B and 6A and 6B, respectively. In FIG. 4A, the only essential differences are that the through hole 600 for the squeegee holder is rectangular and has a small rectangular enlargement 602 at the rear side to provide proper orientation for insertion of the squeegee holder. Also, recesses 604 are provided at each side. From bottom view, FIG. 4B, it will be apparent that vertical slots 606, extending from the bottom and terminating short of the top are located about the rear side of recess 250.

The squeegee holder shown in FIGS. 6A and 6B consists of holder part 700 consisting of block 702 defining a trapezoidal cutout 704. A doctor blade, not shown, is placed in cutout 704 and a trapezoidal plate (inclined sides), not shown, of complementary shape to cutout 704 is pressed into cutout 704 trapping the doctor blade. Like the version previously described, post 706 extend upwardly and terminate with stepped heads 708. The mounting fixture 710 consists of an elongated plate 712 complementary in shape to hole 600 that defines rectangular openings 714 to receive posts 706 and a rectangular projection 716 to fit into recess 602. A semicircular lifting pad 718 extends vertically, at each end of plate 712, a resilient manipulating tab 720 extends vertically. Near the bottom of each tab 720 is a step projection 722 to cooperate with step recess 604. To assemble, a doctor blade is put into recess 704 and trapped by the complementary plate. Holder 700, with coil springs 424, is inserted into fixture 710, so the holder 700 is biased downwardly. Fixture 710 is inserted, appropriately, into hole 600 by flexing tabs 720 toward one another (squeezing together) and releasing when step projections 722 engage in step recesses 604.

Nail holder block 160 is inserted between the side rails 22, 24 in the manner previously described and nail holder 170 is positioned in block 160, as described. A plug 174 with nail rest 176 is inserted into hole 172. Adjustment rod 186 is engaged with lug 182. A person's nail is placed in V-groove 194 and index pointer 204 is mounted on the side nails 22, 24. Knob 192 is rotated in the appropriate sense until the person's nail (upwardly biased) is in the proper indexed position relative to pointing arrow 218. At this time, the pointing arrow 218 is pointing at the exact point on the nail that the image will be deposited. An engraved plate may now be positioned in square recess 134 in wheel 130 or 270. A small quantity of colored image liquid coating material, e.g. taken from a container in a box 40, is placed directly in front of the front-most image. Lever 100 is manipulated (pivoted) rearwardly causing, via control rod, block 230 to slide in slots 70 rearwardly. Block 230 carries pad head 224 and squeegee holder 226 with it. As block 230 slides rearwardly, doctor blade holder 402 will move rearwardly over and in contact with guide surfaces 60 to their rear ends, then contact and pass over the two front blocks 136 whereupon holder block 402 will move down the inclines 135 until the doctor blade bears, under pressure of the springs 424, against the engraved plate immediately in front of the deposited liquid coating material. At this point, the control rod will be in the intermediate part 78 of slot 70 in front of intersection 86. Continued rearward pivotal movement of lever 100 will bring the control rod to intersection 86 at which position doctor blade 400 will have traveled rearwardly in bearing contact with the engraved plate to have doctored excess liquid coating material to the rear of the engraved image and pick-up head 224 will be positioned directly vertically above the engraved image containing the appropriate amount of liquid coating material. Further, rearward force on lever 100 will cause the control rod to move vertically down slot 88 to its bottom at which point the pick-up head will have been forced down a sufficient distance for the pad 244 to have contacted the engraving with sufficient pressure to be able to pick up the liquid coating material in the pattern of the engraved image. Then, the control lever 100 is now pivoted forward to lift the control rod back into slot 70 and to intersection 80 where upon it moves down slot 82 to deposit the coating material onto the person's nail in an exact replica of the engraving. Since the plate may contain four engravings, one on each side, successive repositioning of the plate enables creation ultimately of a four color image on the person's nail. In the same manner, by substituting the golf ball holder for the nail holder, a golf ball can be similarly imprinted with an image.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for applying an art image on a person's nail or an object comprising the steps of (a) establishing a reference point, (b) positioning a person's digit or an object relative to the reference point, (ci) supporting on a support defining projections, in one of a plurality of set positions, an element containing multi-images at a location remote from the person's digit or object so that the multi-images can be presented one at a time, (cii) supporting the support with the projections to interact with stationary structure at the remote location, (ciii) establishing such interaction between the support and the stationary structure to enable manipulation and/or removal of the support from the stationary structure, (d) creating an image composed of image defining coating material of a first image on said image element, (e) picking up the created image from said image element at said remote location, (f) transferring the picked up image to the person's nail or object, (g) depositing the picked up image onto the person's nail or object at a position on the nail or object correlated with the reference point, (h) indexing the support and said supported image element to present' a second image, (i) creating a second image composed of image defining coating material of said second image on said image element, (j) transferring the picked up second image to the person's nail or object, and (k) depositing the picked up second image onto the person's nail or object at a position on the nail or object correlated with the reference point and the deposited first picked up image.

2. A method according to claim 1 wherein each picked up image is transferred by a linear motion.

3. A method according to claim 2 wherein creating each image includes the steps of depositing coating material onto a plate in the vicinity of where the image is created and doctoring excess coating material away from where the image is created.

4. A method according to claim 1 including the step of guiding the transfer of each picked up image.

5. A method according to claim 1 wherein the depositing of each picked up image is effected by a linear motion.

6. A method according to claim 1 wherein the steps are repeated more than two times with presentation of a different image each time to obtain a composite multi-part image on the person's nail or the object.

7. A method according to claim 6 wherein a different color image defining coating material is used each time.

8. A method according to claim 1 wherein the reference point is defined by a pointer.

9. A method according to claim 8 wherein the positioning step includes the step of adjusting linearly the nail or object.

10. A method according to claim 1 further including a step of positively stopping the picked up created image in proper orientation to the person's nail or the object during transfer.

11. Hand operated self contained apparatus for applying an image on a nail of a person's digit or an object comprising:

an element for establishing a reference point, an integrally molded frame, a supporting member defining projections for receiving an image creating plate containing a plurality of images for creating thereon images composed of an image defining coating material, the supporting member being mounted on the frame such that the projections interact therewith to be indexed relative thereto to present different ones of the plurality of images, said interaction enabling the supporting member to be manipulated and/or removed from the frame, a digit or object positioning member for receiving and positioning a person's digit or object relative to the location of the created image, and a transfer member mounted on said frame movable for transferring a created image from the image creating plate to the person's nail or object.

12. Apparatus according to claim 11 further including a plate having more than two images formed thereon mounted on the supporting member.

13. Apparatus according to claim 11 wherein said transfer member includes a squeegee for removing excess coating material from an image and a pick up pad for picking up a created image.

14. Apparatus according to claim 13 wherein said squeegee and said pick up pad are mounted in common and the pad being also mounted for vertical movement.

15. Apparatus according to claim 11 wherein said transfer member is guided linearly during movement.

16. Apparatus according to claim 11 further including guide elements to guide said transfer member during movement.

17. Apparatus according to claim 11 wherein the element for establishing a reference point is a pointer mounted on the frame for indicating the appropriate position of the person's nail or object.

18. Apparatus according to claim 11 wherein the positioning member is movably positioned in the frame for adjustment linearly.

19. Apparatus according to claim 11 wherein the frame and the supporting member define mutually cooperating elements to index the supporting member relative to the frame in a selected one of from two to about eight different relative positions.

20. Apparatus according to claim 11 wherein the supporting member is a wheel.

* * * * *